United States Patent [19]

Tsukamoto

[11] 4,164,999

[45] Aug. 21, 1979

[54] CIGARETTE PACKAGE

[76] Inventor: Tatumi Tsukamoto, 2570, Ohaza Mukaizima, Chiyodamachi, Kanzaigun, Sagaken, Chiyodamachi, Japan

[21] Appl. No.: 886,445

[22] Filed: Mar. 14, 1978

[51] Int. Cl.[2] ..... A24F 15/10

[52] U.S. Cl. ..... 206/91; 206/94; 229/9; 229/19

[58] Field of Search ..... 206/90, 91, 92, 93, 206/94; 229/9, 19

[56] References Cited

U.S. PATENT DOCUMENTS

| | | | |
|---|---|---|---|
| 1,505,133 | 8/1924 | Derry | 206/91 |
| 1,604,838 | 10/1926 | Morden | 206/90 |
| 1,677,036 | 7/1928 | Kratochwill | 206/91 |
| 2,894,619 | 7/1959 | Gallo | 206/93 |
| 2,975,890 | 3/1961 | Block | 206/92 |

*Primary Examiner*—William T. Dixson, Jr.

[57] ABSTRACT

A cigarette package holding a plurality of cigarettes which incorporates therein match sticks and is also provided with a friction surface for striking the matches thereon, so that any inconvenience is not caused when carrying the cigarettes in a pocket or other. Number of the match sticks is preferably equal to or slightly more than the number of cigarettes packed in the cigarette package.

4 Claims, 6 Drawing Figures

CIGARETTE PACKAGE

BACKGROUND OF THE INVENTION

The present invention relates to cigarette packages, and more specifically to cigarette packages of the type, which incorporates therein matches for lighting cigarettes and is provided with friction surface for striking the matches.

It has been necessary for smokers to carry lighting implement such as match box or lighter together with cigarette package. Therefore, when they go out with cigarettes in pocket or other, they must always take care whether match sticks are sufficiently filled in match box or fuel is filled in the lighter sufficiently or not. However, it is often the case that they forget to carry lighting implement with them and become irritated because they can not smoke as desired when they want, and that they must go here and there seeking for a light for cigarette. Such circumstances not only impose mental fatigue on themselves but also give nuisance to others. In view of the above, it is very convenient that a simple lighting implement is combined as a set with a cigarette package. In the meanwhile, from the standpoint of lighting implement for cigarette, match has many important advantages over lighter or others. That is, it is very inexpensive and it is not so regretful if the match is lost. And, it is light in weight so that it is easy to handle and carry. Further, it is free of troubles and naturally any care for fuel is not required. Because of these many advantageous features as above described, match is almost indispensable for smokers. Here, observation is made in detail on the actions or behavior of a person who is going to smoke a cigarette. At first, he takes a cigarette out of the cigarette package and carries it in his mouth, and then he puts the cigarette package near at hand or back into the pocket or other. Subsequently, he takes a match box in his hand and brings a match stick out of the match box, and finally he strikes the match on friction surface of the match box. Thus, many troublesome actions are necessary before he can start smoking. In respect of the above, if actions or procedures necessarily taken before a cigarette is lighted up by the use of match be eliminated or lessened, utility of the match as lighting implement for cigarette will be much enhanced.

SUMMARY OF THE INVENTION

It is therefore an object of the present invention to remove inconveniences and difficulties as above described, which are often experienced by smokers when or before smoking a cigarette, and to make a more extensive use of cigarette package. To this end, it is contemplated that a series of actions necessary upon smoking, starting from taking a cigarette from a cigarette package and ending with lighting of the cigarette, can be carried out in a prompt and reliable manner by the use of a hand that does not have the cigarette package therein.

It is a further object of the present invention to provide cigarette packages of a compact and favorable design, which is equipped with a match set (inclusive of match sticks and friction surface) but designed such that any sharp projection may not be formed on the outside of the package, so as not to cause inconveniences in handling or packing of the same.

It is a still further object of the present invention to provide cigarette packages equipped with a match set, which can always give a sufficient light for lighting a cigarette and is designed to this end such that match sticks may not get out of the package if it is handled a little roughly and friction surface may not be damaged or moistened by dripping of water or other.

It is a still further object of the present invention to provide compact and portable cigarette packages, according to which residual number of cigarettes in the package or pace of smoking can be readily known.

The foregoing and other objects, features and advantages of the present invention will become apparent from the following detailed description and attached drawings on which, by way of example, only the preferred embodiments of this invention are illustrated.

DESCRIPTION OF THE PREFERRED EMBODIMENTS

In accordance with preferred embodiments of the present invention, cigarette packages have an outer size slightly larger than those of the conventional cigarette packages, and they are arranged such that match sticks and friction surface may be provided in the cigarette package, without causing any local projections on the outside of the package.

Now, several preferred embodiments of the present invention will be described in detail with reference to the accompanying drawings.

Figure 1:
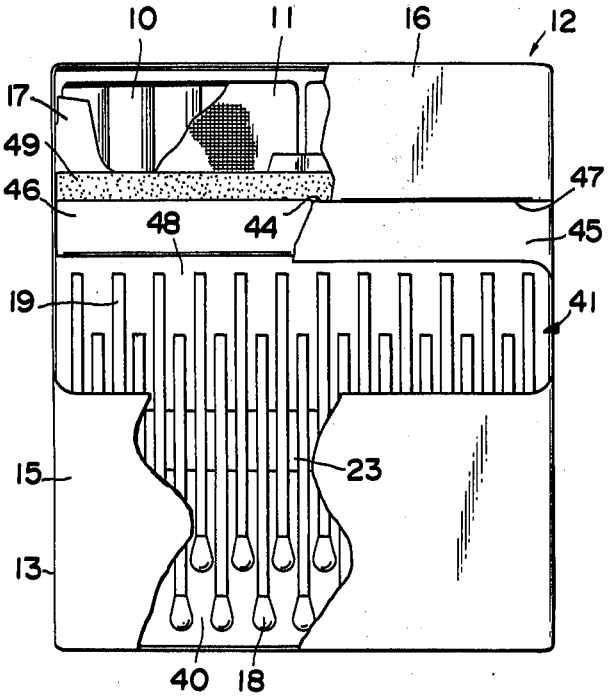
FIG. 1 is a schematic front view of a cigarette package embodying the present invention, which is equipped with a match set, and therein a portion of the cigarette package is shown as cut away to give a better look at the inside of the same.
Figure 2:
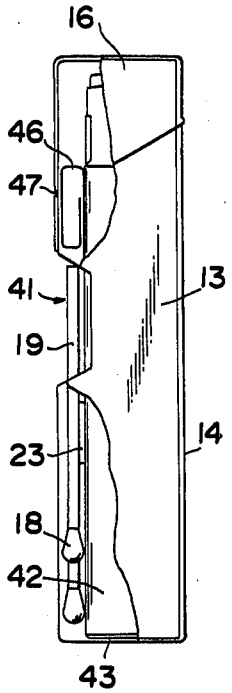
FIG. 2 is a right-side lateral view, schematically showing the cigarette package of FIG. 1, with a portion of the same being cut away.

In FIGS. 1 and 2, there is shown a cigarette package embodying the present invention on one of typical cigarette packages, available on the market, in which twenty cigarettes are packed. In this example, each ten cigarettes 10 are arranged in two layers consisting of five cigarettes, and these ten cigarettes 10 are wrapped by a thin film or foil of aluminium into one cigarette pack 11. And, two such packs 11 are placed in a cigarette package body 12 in side-by-side relationship. This cigarette package body 12 is made of a sheet of thick paper or cardboard, folded suitably into shape, and both side walls 13 of the package body 12 include an inner layer folded from the side of rear wall 14 and an outer layer folded from the side of front wall 15. And, these two side layers are stuck on each other with paste. At the top of the front wall 15 is provided a cover 16 which can be opened upward pivotally about an upper portion of the rear wall 14, so that cigarettes can be taken out of the package body 12. A frame structure 17 is fitted in the cigarette package body 12 for guiding the cover 16 and also reinforcing the packs 11 and cigarette package body 12, and it is firmly fixed to the inner wall faces of the package body 12 by way of pasting. Match sticks 19 may be disposed either on the inside or outside of the package body 12 along the wall surface thereof, but in this example, slender match sticks 19 are disposed on the inside of the package body 12. In more detail, a match board 40 made of thick paper is inserted at the front of two cigarette packs 11, twenty-three match sticks inclusive of three spare match sticks are arranged on the outside of the match board 40 facing the front wall 15, with their lighting tips 18 lying downward, and they are disposed in side-by-side relationship with each other to form generally a flat layer of match sticks 19. And, in the arrangement of this example, these match sticks 19 are alternately displaced in their axial directions as shown in the drawing, and further on the outside of the match board 40 is fixed a laterally extending retainer plate 23 in the form of a thick belt. It is fixed in place also by way of pasting. Each of the match sticks 19 is stuck to the retainer plate 23 at an intermediate portion of the same, and therefore they are held on the match board 40 by means of this retainer plate 23. Accordingly, match sticks 19 are held apart from the surface of match board 40 except for their lighting tip portions, so that they are held substantially in parallel with each other, with a small clearance being formed between themselves and the match board 40.

The cigarette package body 12 is made in the form of a box, having a thickness sufficient for receiving cigarette packs 11 and match board 40 having thereon match sticks 19. And, an opening 41 for taking out match sticks 19 is provided at a portion of the front wall 15 corresponding to end portions of the match sticks 19, and the opening 41 has a sufficient width such that match sticks 19 can be readily taken out from the opening 41.

In the example shown in FIGS. 1 and 2, the opening 41 for taking out match sticks 19 is formed at an upper portion of the front wall 15, and end portions of the match sticks 19 are exposed slightly inwards of the front wall.

Also in the above example, the match board 40 is provided at both side end portions and the lower end portion with side covers 42 and bottom cover 43, which are so folded as to respectively cover both side faces and bottom faces of the cigarette packs 11. Further, at the upper end portion of the match board 40 is provided an inner pad 46 in the form of a thick belt-like strip, which is intended to support an upper portion 45 of the front wall 15, and the pad 46 is protruded several millimeters upwards of the upper end 44 of the front wall 15. In this example, the pad 46 is formed by folding the upper end portion of match board 40 into a form having a rectangular cross section at the upper end portion of the match board 40, as shown in the drawing. And, the pad 46 serves to positively support the upper end portion 45 of the front wall 15, and at the same time, when the cover 16 is closed, it is held in tight contact with the inside of front wall 47 of the cover 16, so as to keep airtightness of the package body 12. These side covers 42, bottom cover 43 and pad 46 of the match board 40 are bonded to inner walls of the package body 12 suitably by way of pasting, so that outer faces of the match board 40 are held firmly in the package body 12 and air-tightness at the peripheral portion of the match board 40 can be maintained. Thus, it is prevented that moisture enter into the package body 12. When taking out a match stick 19, end portion of the match stick 19 is held lengthwise by fingers and taken out from the opening 41 by pulling the same outwards. Although match sticks 19 are disposed in close contact with each other in the arrangement of this example, spaces 48 are formed at the end portions of the match sticks 19 so as to allow access of fingers, since the match sticks 19 are alternately displaced in their axial directions as described in the foregoing.

The arrangement being as above, if those match sticks alternately protruded upward are used at first, similar spaces allowing access of fingers can be formed also between match sticks 19 retracted downward, so that all the match sticks 19 can be taken out smoothly. Further, in the arrangement of this example, match sticks 19 are held apart from the surface of match board 40, so that holding of the match stick by fingers is rendered much easier.

To those skilled in the art, however, it will be apparent that various modifications are possible on the arrangement for giving such spaces 48, which allow easy access of fingers, other than the aforementioned arrangement in which match sticks 19 are alternately displaced in their axial directions.

A friction surface for igniting the match through frictional contact between them can be provided at a suitable place on the outer wall surface of the package body 12.

In this example, a friction surface 49 is provided on a portion of the pad 46 located upwardly of the upper end portion 45 of the front wall 15. This portion of the pad 46 is covered by the front wall 47 of the cover 16, when the cover 16 is closed. Therefore, if the inside of a pocket having therein a cigarette package get wet by rain or other, the friction surface 49 can be protected from mositure or water.

Figure 4:
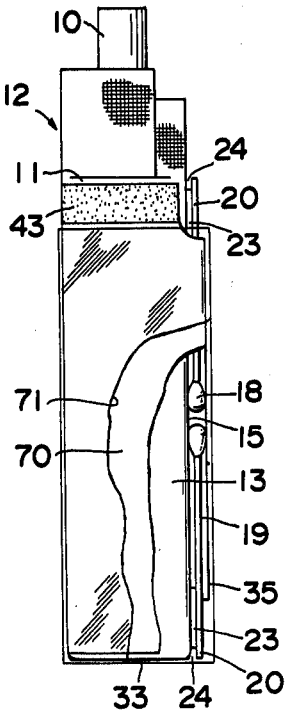
FIG. 4 is a left-side lateral view, showing schematically the cigarette package of FIG. 3, with a portion of the same being cut away.
Figure 3:
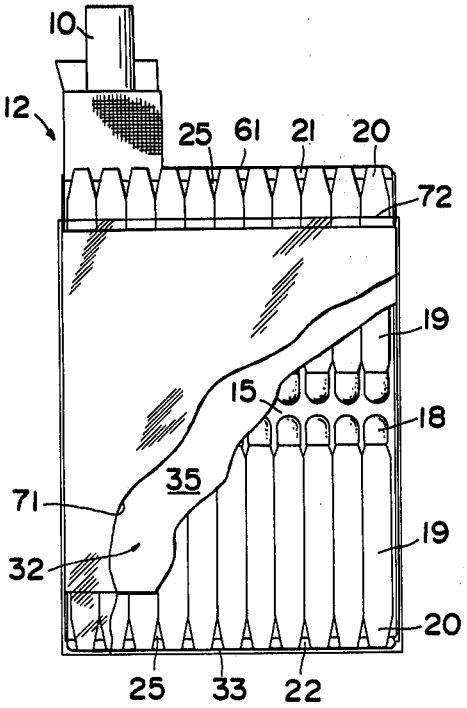
FIG. 3 is a schematic front view of another cigarette package with a match set, embodying the present invention, and a portion of the package is shown as cut away to give a better look at the inside.

In another embodiment of the present invention shown in FIGS. 3 and 4, a cigarette package body of the most popular type, widely available on the market, is shown and it holds twenty cigarettes therein arranged in three layers. These cigarettes are wrapped by a sheet of aluminium foil into a cigarette pack 11, similar to a thick pocket-book, and they are wrapped further by a thin sheet of outer wrapping paper, having brand or other printed thereon.

The cigarette package body 12 is sealed at its upper wall 61, and a corner portion of the aluminium foil wrapping the cigarette pack 11, exposed at the upper wall 61, is cut away as shown in the drawing so as to facilitate to take out a cigarette 10. In this example, laterally extending two retainer plates 23 made of thick paper are bonded to the aforementioned outer wrapping paper respectively at an upper and a lower portions of the front wall 15 of the package body 12, a little spaced from the upper and lower end portions 21 and 22. These retainer plates 23 have a strength sufficient to stand the force exerted when tearing of the match sticks, and they are further provided with a sufficient width and thickness so that they can be firmly pasted onto the outer wrapping paper for the front wall 15 and they may not be detached from the same when tearing off match sticks. And, two rows of eleven matches 19 in the form of a flat slender strip are arranged on the front wall 15 in side-by-side relationship with each other, and these two rows of matches 19 face toward each other with their lighting heads or tips 18 being disposed on the inside and their end portions 20 being disposed in alignment with end portions 21 and 22. And, these matches 19 are pasted at their backs to the retainer plates 23. With such an arrangement, spaces 24 are formed between the surface of the front wall 15 and the backs of the end portion 20 of the matches 19, so that it gives convenience in holding the end portion 20 by fingers, when tearing off a match 19. Further, because of the arrangement that match sticks 19 are pasted on thick and fairly strong retainer plates 23, it is easy to detach them from the plates 23. If the match sticks 19 are pasted to the retainer plates 23 at a portion thereof as remote as possible and with a bonding strength as weak as possible, detachment of the match 19 will be rendered easier. Further, because of the arrangement that end portions 20 of the matches 19 are disposed in alignment with the upper wall 61 and the lower wall 33 of the package body 12, it is easy to hold the end portion 20 of a match 19 with fingers and the match 19 can be readily brought outward.

Further, in the arrangement of this example, end portions 20 of each of the matches 19 are cut off at its both side portions or slenderized toward their ends, so that spaces 25 are formed at the end portions 20 between adjacent two matches 19. Through the provision of such spaces 25, it is prevented that more than two matches be detached by mistake, when only one match is necessary, and thus the match can be detached without any difficulty from the retainer plates 23.

In the example as illustrated in FIGS. 3 and 4, two spare matches are additionally provided for twenty cigarettes. Provision of these two spare matches is mainly for possible failures in lighting matches. However, matches can be used for various purposes other than lighting a cigarette, and thus two spare matches will be useful for such purposes. In carrying out the present invention, number of these spare matches could be freely selected in consideration of various requirements.

Matches 19, thus arranged on the front wall 15, are covered at the front by a match cover 32, which is made of thick paper. The match cover 32 includes a front cover portion 35 adapted for covering the front of the matches 19 and side wall cover portions 70 folded at the right and the left ends of the front cover portion 35 toward respective side walls 13 and fixed thereon by way of pasting. In the illustrated example, the side wall cover portions 70 cover respective side walls 13 completely and have a width slightly larger than that of the side wall 13, and the front cover portion 35 has a size sufficiently large for covering the front of the matches 19. And, the front cover portion 35 is cut away at its upper and lower end portions and therefore end portions 20 of the matches 19 are exposed to the outside, thus affording convenience in holding and taking out the end portion 20 of the match. By the match cover 32, matches 19 can be positively protected from external forces or moisture, and at the same time, it is prevented that cigarette package body 12 be deformed by external forces or cigarettes in the package body 12 be acted by a locally concentrated force. Accordingly, such inconveniences that cigarettes are deformed or folded while carrying the same in a pocket or other can be removed. At the same time, there can be provided a cigarette package, which can positively withstand the force acted when tearing off a match 19, independently of the number of residual cigarettes in the package body 12.

The arrangement of a cigarette package, as shown in FIGS. 3 and 4, provides a best method for arranging matches in the cigarette package, according to which a suitable number of matches in the form of a flat slender strip, having sufficient length and width, can be efficiently received in the package and a series of actions, starting from taking out a cigarette, tearing off a match stick and ending with striking the match on a friction surface, can be carried out very smoothly. Therefore, the arrangement of this example can be applied not only on cigarette packages which are wrapped by a thin wrapping paper, but also applied on similar cigarette packages which are made of rather thick paper, without changing the above arrangement in the least.

In the example of FIGS. 3 and 4, a friction surface 43 is provided on a side wall cover portion 70, which is exposed upwardly of the top 72 of unsealed cellophane cover 71.

In a further embodiment of the present invention as described hereinbelow, match sticks are provided on a side wall of a cigarette package body by the use of a suitable match holding means such as match box.

Figure 6:
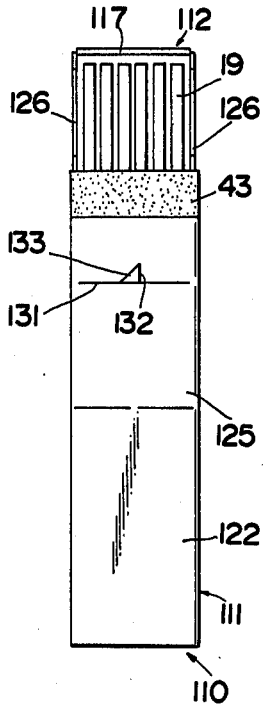
FIG. 6 is a left-side lateral view, showing schematically the cigarette package of FIG. 5.
Figure 5:
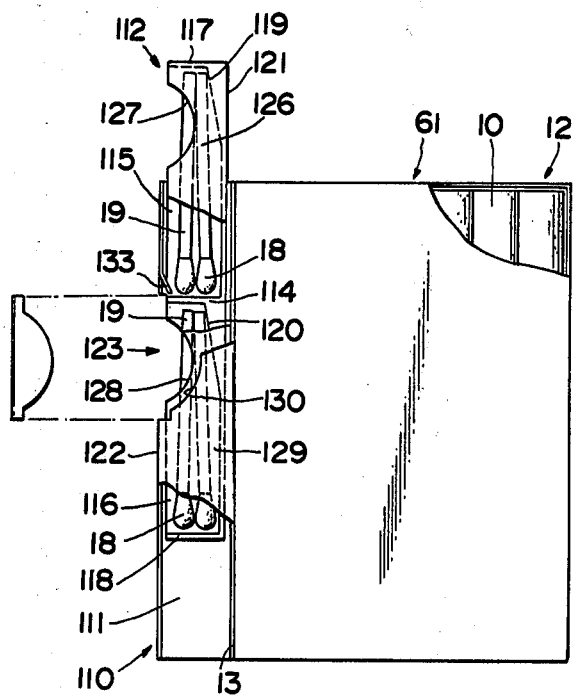
FIG. 5 is a schematic front view of a further cigarette package with a match set, embodying the present invention, and a portion of the package is shown as cut away to give a better look at the inside.

In FIGS. 5 and 6, there is shown a further embodiment of the present invention, exemplified on a cigarette package, which has therein twenty cigarettes arranged in three layers. Cigarettes 10 are received in a cigarette package body 12, which is made of a rather thick paper. This cigarette package body 12 has therein a well-known cigarette receptacle or inner box, which can be freely slided upward and downward in the cigarette package body 12, and cigarettes 10 can be taken out from the upper wall 61 of the body 12. In the arrangement of this example, a match box 110 is provided on one of the side walls 13 of the cigarette package body 12, and it has outer sizes equal to those of the side wall 13 of the cigarette package body 12. The match box 110 includes an outer frame 111, which has a small width and has a substantially rectangular cross section elongated considerably in a vertical direction, and an inner receptacle box 112 which can be slided vertically in the outer frame 111, and the match box 110 is bonded on one of the side walls 13 as described in the foregoing. The elongated receptacle box 112 is divided at a middle portion of its length into an upper chamber 115 and a lower chamber 116 by means of a lateral partition 114. Eleven or twelve matches 19 are received respectively in these two chambers, with their lighting heads or tips 18 being disposed downward.

In the example shown in FIGS. 5 and 6, the thick paper forming the receptacle box 112 is folded inwards at its upper end portion 117 to form an upper bottom face 119, and it is folded outwards at the middle portion of the box 112 to form the aforesaid partition 114. It further extends downward to the lower end 118, forming a lower bottom face 120. At the respective upper end portions of the upper and the lower chambers 115 and 116, depth of the receptacle box 112 is reduced and thus inner bottom faces 119 and 120 respectively of the upper and the lower chambers 115 and 116 are slightly spaced from the bottom 121 of the box 112. By reason of the restriction on lateral size or width of the box 112, it is necessary to make the depth of the match box 112 a little larger than suitable for the width. Therefore, as the number of residual matches in the box 112 is lessened, it becomes difficult to hold the match stick with fingers.

The reason of the above arrangement, in which depth of the match box 112 is reduced at end portions of the match sticks 19, is to overcome the above-described difficulty. That is, because of such arrangements, it is facilitated to hold the match stick 19 to the last one. Thus, match sticks are received, in upper and lower two chambers and in a plurality of layers, in the match box 112 which has extremely limited width and length, so that loose match sticks 19 can be arranged on the side wall 12 in an extremely compact manner.

Further, in this example, a cut 131 for providing a lower chamber opening 123 is formed, during manufacturing of the match box 112, at the central portion of the front wall 122, and thus a cover 125 for the lower chamber opening is provided. The cover 125 for the lower chamber opening 123 can be readily removed by fingers, when the user begins to use the matches 19 in the lower chamber 116 Thus, upon smoking a cigarette, a cigarette 10 is at first taken out from the cigarette package body 12, and then lower end 118 of the receptacle box 112 is pushed upward by finger or other to project the same by a suitable amount, as shown in the drawings. And then, a match 19 can be taken out from either of the openings. In general, the lower chamber opening 123 is closed, as shown in FIG. 6, by the cover 125 which forms a part of the front wall face 122 of the outer frame 111, until matches in the upper chamber 115 are all spent. In FIG. 5, however, the cover 125 for the lower chamber opening 123 is shown as removed, so as to give a better understanding of the arrangement of this example.

As apparent from the foregoing description, arrangement of the upper and the lower chambers 115 and 116 of this example is such that matches 19 are taken out by opening the upper portion of these chambers. Such an arrangement, however, does not constitute any substantial part of this invention and therefore it is possible to arrange otherwise. But, in general, a smoker takes a cigarette package in one hand with an opening for taking out the cigarettes being disposed upward, as shown in the drawings, and he takes out a cigarette with the other hand. And, he gets to the next action unconsciously. As can be seen from the above, in the arrangement of a match box 110 in which match sticks 19 are received loosely, it is important to design the match box 110 such that matches 19 may not be dropped out of the box 110, if the receptacle box 112 is opened with the opening for taking out cigarettes being disposed upward.

Further, in both side walls 126 of the receptacle box 112, round cut-away portions 127 and 128 are provided upwardly of the upper and the lower chambers 115 and 116, in other words, at the positions suited for taking out the matches 19, and they have a size sufficiently large for allowing finger to pass therethrough. These cut-away portions 127 and 128 respectively have the upper end at a position slightly downwards of the upper end 117 and partition 114, respectively forming the upper wall of the upper and the lower chambers 115 and 116, so that it is prevented that end portions of the matches 19 be protruded out of the side walls 126 of the box 112. At the central portion of both side walls 129 of the outer frame 111, there are provided similar cut-away portions 130, adapted to come into registry with the cut-away portion 128 of the lower chamber 116. These cut-away portions or notches 130 are made a little larger than the notches 128, so that they can be registered with corresponding notches 128 with some tolerance when the receptacle box 112 is protruded upward to its optimum elevated position.

In this example, the notches 130 mating with corresponding lower notches 128 are formed integrally with the cover 125 for the lower chamber opening 123, and simultaneously with the removal of the cover 125, these notches 130 are provided in side walls 129 of the outer frame 111. By virtue of such notches 130, a match 19 near the side wall 126 can be easily held by fingers, if match sticks 19 are packed in the box 112 in close contact with each other.

The round shape of these notches, shown in this example, is one of the most preferable forms which does not reduce the strength of the receptacle box 112 and does not affect motion of the box 112 in the outer frame 111. However, it will be possible to employ other shapes than the round one. Further, it will be also possible to provide such notches only on one side of the match box 110 and receptacle box 112.

in the arrangement of a match box, which is attached on one side wall of a cigarette package body and divided into upper and lower two chambers as in this example, it is inevitable to reduce the length of the match sticks, so that optimum amount for protrusion of the receptacle box is considerably limited. That is, if the receptacle box is pushed upward too much and cigarette package is tilted abruptly, match sticks may possibly drop out of the match box. Further, at the side of the lower chamber, such a difficulty may possibly be caused that end portion of the match stick is caught on the upper end portion of the lower chamber opening and thus the match stick can not be taken out smoothly.

In consideration of the above difficulties, a special arrangement is made on the match box such that its receptacle box 112 is stopped at a position giving an optimum opening of the same. That is, a short vertical cut 132 is provided in front wall surface 122 of the match box 110, at the middle portion of the upper cut 131 on the side of upper end of the cover 125, and it extends upward from the upper end portion of the cover 125. One of the corners, formed by intersecting two cuts 131 and 132, is folded inward as shown in the drawing and thus an inwardly protruded stopper projection 133 is provided. When receptacle box 112 is pushed upward, the stopper projection 133 comes into abutment with the upper surface of the central partition 114, so that the receptacle box 112 is prevented from being further pushed upward. The stopper projection 133 is provided at a position on the front wall surface 122, such that it may function at the aforementioned optimum opening position of the receptacle box 112. With such an arrangement, the receptacle box 112 can be pushed to its optimum position correctly and without difficulty, through the sense on fingers. In this example, a friction surface 43 is provided at an upper portion of the front wall surface 122.

Here, it is to be noted that the above stopper projection 133 can be formed in various other structures and shapes. In the arrangement of this example, the stopper projection 133 does not function when the receptacle box 112 is moved downward in the outer frame 111, and therefore it has an advantageous feature that any inconvenience is caused when inserting the receptacle box 112 into the outer frame 111.

Further, it is also possible to provide such a stopper projection at a position lower than the cover 125 for the lower chamber opening 123, and in this case the projection is co-operated with the lower end portion 118 of the box 112. Thus, it will be apparent to those skilled in the art that such stopper means similar to the stopper projection 133 of this example can be provided at other places of the match box 110.

In accordance with the arrangements of the foregoing several examples, in which match sticks are received in a holding means contrived to suit the respective exemplified embodiments and the match holding means is coupled with the cigarette package body, rather complicated process for coupling the match to its cigarette package body can be separated from the cigarette packing process. Here, it is to be understood, however, that it is also possible to attach match sticks directly on the side wall of the cigarette package body. Further, it is also possible to form a similar match holding means in the cigarette package body itself, although in the foregoing several embodiments of this invention, these match holding means are provided separately from the cigarette package body. Further, it is also possible to make various modifications or changes in the inside structure of the match holding means such as match boxes as described with reference to the foregoing examples. Although the present invention has been described with respect to specific details of certain embodiments thereof, it is not intended that such details impose limitations on the instant invention in any sense, and various changes and modifications can be made in the above described structures which provide the characteristics of this invention, without departing from the spirit of the same.

The arrangements as described above with reference to several embodiments of this invention have an advantageous feature, however, that thickness of the cigarette package is not so much increased due to attachment of a match box and therefore pocket or other for holding the cigarette package is not so much inflated. Thus, they provide convenience in carrying the cigarette package.

It will be possible to make various modifications on the manner of coupling match sticks to the cigarette package body, and although only a few preferred embodiments are described and illustrated in the foregoing, it is not intended that they impose limitations on the scope of this invention in any sense.

One of the advantageous features of the arrangements of the above-described embodiments, in which match sticks are taken out by holding the end portion of the same, is that there is a least fear of wetting lighting or igniting agent applied on the tip of the match stick, if the match is touched by a wet hand. Further, since the arrangement is such that match sticks are made in a size as short as possible and they are held by fingers at a position most suited for striking the same on friction surface, it is not necessary to change direction of the match stick in hand or re-hold the same before striking the match on friction surface. Thus, the user can get smoothly to match striking action.

Shape of the match sticks is not limited to those as shown with reference to the foregoing three embodiments. Most simply, it is possible to attach commonly used match sticks directly on a wall of cigarette package body, in similar manner as described in the foregoing examples.

For long, those who smoke have been convinced that to carry a cigarette package together with a match box with them is the same as carrying cigarettes and lighting implement as a set, and they have been so accustomed and satisfied with this custom. It is troublesome to check up the number of cigarettes in the package as well as the number of match sticks, for example, before going out somewhere to the outside. However, smokers do not dare to throw away matches in hand and buy a packet of cigarettes together with a new match. If it is known that considerable number of match sticks are left in the match box in a pocket, it is natural to buy only a packet of cigarettes. Therefore, it is not always ensured that sufficient number of match sticks are left for use in lighting the cigarettes left in the package, and shortage of match will surely occur some time. In light of the above difficulties, the present invention provides cigarette packages which incorporates therein a corresponding number of match sticks to the number of cigarettes, so that it is not necessary to a match together with cigarette. Thus, smokers can be relieved from the troublesomeness as above described concerning the lighting implement, although it may result that a few spare matches left in the match box are sometimes discarded without use. In addition to the above, it is another advantageous feature of this invention that a series of actions necessary before a cigarette is lighted up can be improved. When taking out a match stick from a match box or otherwise tearing off a match stick from a match packet, it has been necessary that the match box or the match packet be held by one hand with a suitable inclination. Further, it is also necessary, upon striking the match on friction surface of the match box or the match packet, that the friction surface be held by one hand in a direction suited for striking of the match. Thus, both hands are necessary to light a cigarette with a match, and resultantly there is required a troublesome action interchanging the cigarette package and match box from one hand to the other. But, in accordance with the present invention, match sticks are provided on a wall of a cigarette package, so that they can be taken out with ease, and a fresh friction surface is always provided at a suitable place of the wall of a cigarette package body. By virtue of such arrangements, a series of actions, starting from taking a cigarette from the package and ending with lighting up of the cigarette, can be carried out smoothly by the use of one hand, while holding the cigarette package in the other hand. Further advantageous features of the present invention are that the above-mentioned two advantages can be enjoyed without the need of any special maintenance on the lighting implement, and that cigarettes and its lighting implement can be carried compactly and very conveniently and at the same time they can withstand rather rough treatment. Indeed, a smoke in the intervals of business soothes the nerves and serves to cause a will for the next job. Thus, the present invention is intended to be of some help to the healthy smoking.

What is claimed is:

1. A cigarette package comprising;

a package body adapted for receiving cigarettes therein and including a front wall, a rear wall, opposite side walls, an upper wall and a lower wall; and a match box attached on one side wall of the package body, the match box including a rectangular outer frame having a back wall surface conforming to the shape of a side wall of said package body and a receptacle box adapted to be freely slidable in said outer frame and divided into upper and lower chambers by a partition, the upper and lower chambers adapted to receive matches therein, the outer frame having a detachable cover over an opening in the lower chamber, which cover is removable after unsealing of the cigarette package so that when the receptacle box is pushed upwardly the matches can be removed from both the upper and lower chambers thereof.

2. A cigarette package as set forth in claim 1, wherein the match box is provided with means for stopping slidable movement of the receptacle box at a sufficiently open position to expose said matches for removal when said match box is pushed upwardly.

3. A cigarette package as set forth in claim 2, wherein the means for stopping slidable movement of the receptacle box at said open position comprises a projection provided on the front wall of the outer frame of said matchbox extending toward the inside of the receptacle box and engageable with the upper surface of said partition of the receptacle box when said box is pushed upwardly.

4. A cigarette package as set forth in claim 1, wherein the match box includes notches formed in at least one side wall of said receptacle box at respective match holding positions in the upper and lower chambers thereof, and mating notches provided in said outer frame adjacent the opening in said lower chamber registerable with a notch in the lower chamber of the receptacle box.

* * * * *